US009725903B2

(12) United States Patent
Hostetler et al.

(10) Patent No.: US 9,725,903 B2
(45) **Date of Patent: *Aug. 8, 2017**

(54) SYSTEM FOR RETROFITTING AND ENHANCING THE THERMAL RESISTANCE OF ROOFS AND WALLS OF BUILDINGS

(71) Applicant: BLUESCOPE BUILDINGS, NORTH AMERICA, INC., Kansas City, MO (US)

(72) Inventors: William Hostetler, Grandview, MO (US); Tori Johnson, Lee's Summit, MO (US); Cliff Robinson, Blue Springs, MO (US); Richard Grabmeier, Shawnee, KS (US)

(73) Assignee: BLUESCOPE BUILDINGS NORTH AMERICA, INC., Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/145,046

(22) Filed: May 3, 2016

(65) Prior Publication Data

US 2016/0244964 A1 Aug. 25, 2016

Related U.S. Application Data

(63) Continuation-in-part of application No. 14/935,989, filed on Nov. 9, 2015, now Pat. No. 9,580,909.

(60) Provisional application No. 62/117,214, filed on Feb. 17, 2015.

(51) Int. Cl.
*E04C 1/00* (2006.01)
*E04C 2/34* (2006.01)
(Continued)

(52) U.S. Cl.
CPC ..... *E04C 2/34* (2013.01); *E04C 2/284* (2013.01); *E04D 3/3601* (2013.01); *E04D 3/361* (2013.01);
(Continued)

(58) Field of Classification Search
CPC . E04C 2/34; E04C 2/284; E04D 3/361; E04D 3/364; E04D 13/1618;
(Continued)

(56) References Cited

U.S. PATENT DOCUMENTS 4,058,949 A 11/1977 Bellem et al.
4,391,075 A 7/1983 Musgrave
(Continued)

OTHER PUBLICATIONS

PCT/US2016/018259 Search Report and Written Opinion dated Jun. 23, 2016, 12 pages.
(Continued)

*Primary Examiner* — Basil Katcheves
(74) *Attorney, Agent, or Firm* — Lathrop & Gage L.L.P.

(57) ABSTRACT

An insulating system for retrofitting the roof and/or walls of a building. The retrofit system includes a first layer of insulating material extending transverse to the purlins, girts and chords and atop the existing roof or wall structure as well as a plurality of longitudinally extending bridge members each with an upper and a lower surface. The system also includes a plurality of orthogonally extending spacer members that compresses the first layer of insulating material proximate to the spacer members and allowing an otherwise uncompressed first insulation layer to span between the spacer members. The system further includes a second layer of insulation extending across the upper surface of the bridge members wherein a plurality of panel clips each with a panel clip tab are disposed atop the second layer of insulation and are fastened to the bridge member and the clip tabs engage with the lateral edges of the roof or wall panels in the formation of a water resistant seam.

20 Claims, 13 Drawing Sheets

(51) Int. Cl.

| | |
|---|---|
| ***E04D 3/36*** | (2006.01) |
| ***E04C 2/284*** | (2006.01) |
| ***E04D 3/361*** | (2006.01) |
| ***E04D 3/367*** | (2006.01) |
| ***E04D 13/16*** | (2006.01) |
| *E04B 1/38* | (2006.01) |

(52) U.S. Cl.
CPC ..... *E04D 3/3602* (2013.01); *E04D 3/364* (2013.01); *E04D 13/1618* (2013.01); *E04B 2001/405* (2013.01); *E04D 2003/3615* (2013.01)

(58) Field of Classification Search
CPC ..... E04D 3/3602; E04D 3/3601; E04D 2003/3615; E04B 2001/405
USPC ..... 52/309.1, 404.1, 407.1, 408, 478, 409, 52/410
See application file for complete search history.

(56) References Cited

U.S. PATENT DOCUMENTS

| | | | | |
|---|---|---|---|---|
| 4,516,371 | A | 5/1985 | Simpson | |
| 4,573,298 | A * | 3/1986 | Harkins | E04D 12/00 52/404.3 |
| 4,642,961 | A | 2/1987 | Cruise | |
| 4,651,489 | A | 3/1987 | Hodges et al. | |
| 4,810,938 | A | 3/1989 | Johnson et al. | |
| 5,408,797 | A | 4/1995 | Bellem et al. | |
| 5,857,292 | A * | 1/1999 | Simpson | E04B 7/024 52/22 |
| 5,911,663 | A | 6/1999 | Eidson et al. | |
| 6,233,894 | B1 | 5/2001 | Abney et al. | |
| 8,316,605 | B2 | 11/2012 | Oberg | |
| 8,371,083 | B2 | 2/2013 | Chamberlin et al. | |
| 8,621,805 | B2 | 1/2014 | McClure | |
| 8,627,628 | B2 | 1/2014 | McClure | |
| 8,661,763 | B2 | 3/2014 | Oberg | |
| 8,713,884 | B2 | 5/2014 | Musick et al. | |
| 2011/0078973 | A1 * | 4/2011 | Oberg | E04D 3/3603 52/582.1 |
| 2012/0255252 | A1 | 10/2012 | McClure | |

OTHER PUBLICATIONS

U.S. Appl. No. 14/935,989 Office Action dated Jul. 18, 2016, 21 pages.
U.S. Appl. No. 14/935,989 Notice of Allowance, dated Dec. 14, 2016, 12 pages.

* cited by examiner

SYSTEM FOR RETROFITTING AND ENHANCING THE THERMAL RESISTANCE OF ROOFS AND WALLS OF BUILDINGS

RELATED APPLICATIONS

This application claims the benefit of priority to U.S. Application No. 62/117,214 filed on Feb. 17, 2015 and U.S. application Ser. No. 14/935,989 filed on Nov. 9, 2015.

TECHNICAL FIELD

This disclosure relates generally to the field of retrofitting roof and wall structures of metal buildings while enhancing the thermal resistance of the structures.

BACKGROUND

For decades insulation has been used in metal buildings to retard thermal transfer through the roof as well as the wall structures. Typical roof and wall insulation configurations use blanket insulation. The thermal resistance offered by the insulation is compromised when it is compressed or packed down. In conventional metal roof and wall insulation systems, when the roof structure is applied to the tops of the roof purlins, or the wall structure is applied to the girts, the thick layer of blanket insulation is compressed, thus reducing the thermal resistance of the insulation system. In some areas of the conventional roof and wall systems, the compression of the insulation is so severe that a thermal short is created, thus substantially degrading the insulation properties of the insulation system.

Additionally, there is a growing interest in increasing the insulating capabilities of roofs of existing buildings. As the state of the art of roof and wall insulating systems advances, owners and operators of these structures are demanding retrofit options for existing roofs and walls to drive down the costs associated with the heating and cooling of these structures. In addition, retrofit roofs and walls can generally be added to existing structures at a fraction of the cost of replacing the building and due to further advances in the roof and wall retrofit systems the owner and operator often see improvements in the capacity of the structure to resist moisture intrusion brought about by rain and snow.

SUMMARY

According to a first aspect, the present disclosure provides a system for retrofit insulating roofs and walls. In older buildings the standard configuration utilized included a first layer of either fiberglass or rigid board insulation disposed atop a longitudinally extending roof purlin upper chord of a roof truss or wall girt. Typically disposed atop the first layer of insulation is a roofing panel. In a retrofit scenario disposed atop the existing roof panel are layers of rolled insulation adjacent one another and covering the entire roof structure. The retrofit hardware is comprised of a plurality of longitudinally extending bridge members oriented with and overlaying the purlins or girts. Disposed beneath the bridge members and atop the newly installed rolled insulation is a plurality of discrete insulating bridge blocks or brackets, also referred to as spacer members, intermittently disposed beneath the bridge members. Atop the insulating bridge blocks or brackets is a supplemental insulating element continuous with the longitudinally extending upper chord disposed atop the intermittently disposed insulating bridge blocks or brackets. Adjacent the supplement insulating element is a bridge that may include a plurality of upwardly extending tab elements, the bridge overlaying and contiguous with the supplemental insulating element.

A second layer of rolled insulation disposed atop and contiguous with the bridge is then interwoven into the roof insulating structure. A plurality of panel clips are then secured with fasteners through each of the second layer of insulation, bridge, supplemental insulating element, discrete bridge blocks or brackets, first layer of insulation and upper chord, the panel clips being intermittently disposed along the longitudinally extending upper chord.

A comparable configuration of insulating elements including layered insulation, discrete spacer members and a plurality of panel clips or fasteners are utilized to secure a wall panel to horizontally spaced building girts thereby providing a system that eliminates thermal transfer short circuits in the walls. Likewise, this disclosed configuration may also be utilized to retrofit an existing roof or wall structure with only slight modification.

BRIEF DESCRIPTION OF THE DRAWINGS

The foregoing and other features and advantages will be apparent from the more particular description of preferred embodiments, as illustrated in the accompanying drawings, in which like reference characters refer to the same parts throughout the different views. The drawings are not necessarily to scale; the sizes of elements may be exaggerated for clarity.

DETAILED DESCRIPTION

Figure 1:
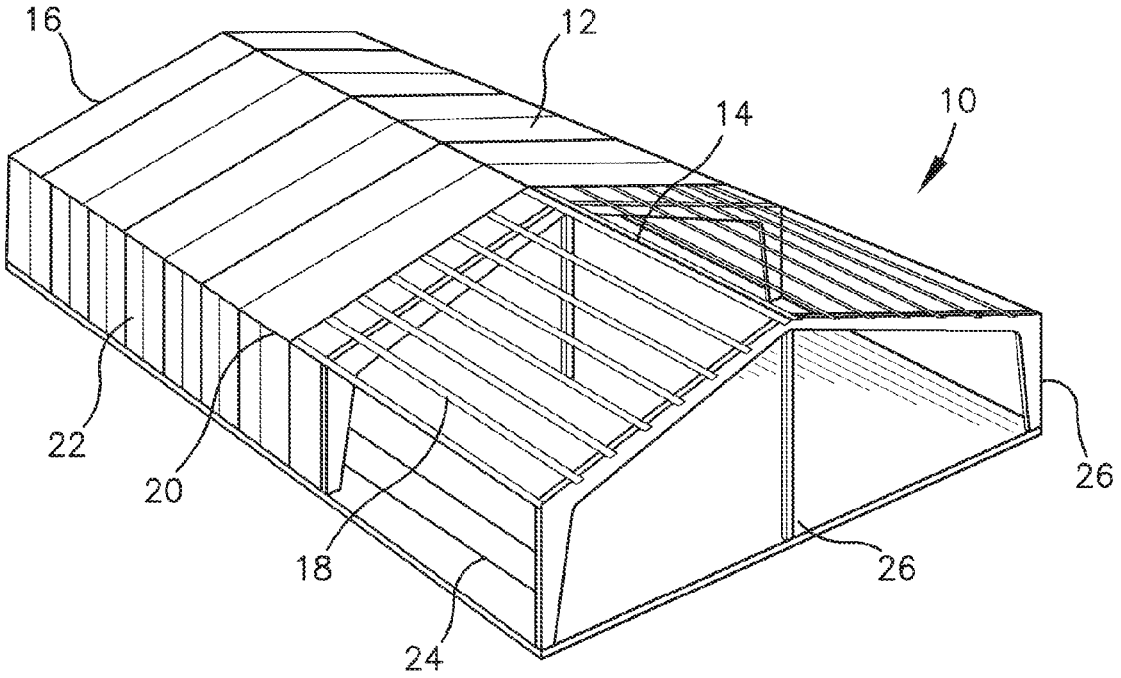
FIG. 1 is a perspective view with portions broken away of a metal building structure of a type for which the insulated metal roof structure of the present disclosure is suitable.

A building roof and wall insulating system 10, as seen in FIG. 1, comprises the installation of insulating elements within the roof and wall structural features of a building 12. A roof structure 14 including roof decking or sheeting 16 that are supported by purlins 18. Purlins are structural members in a roof that span parallel to the building eave 20, and support the roof decking or sheeting 16. Sandwiched between the purlins 18 and the roof decking 16 are insulating elements, of various embodiments, that are described in greater detail below.

The retrofit insulating system 10 detailed herein is equally applicable to insulating a wall panel 22 of a building 12 to limit the transfer of heat. The structural features disclosed herein may also be utilized to retrofit an existing roof or wall to enhance the thermal resistance of the building. Supporting the wall panels 22 are girts 24 that work in conjunction with columns 26 and the wall panels 22. The girts 24 are horizontal structural members in a framed wall that provide lateral support to the wall panels 22, primarily to resist wind loads and to assist in the attachment of the wall panels 22.

Figure 2:
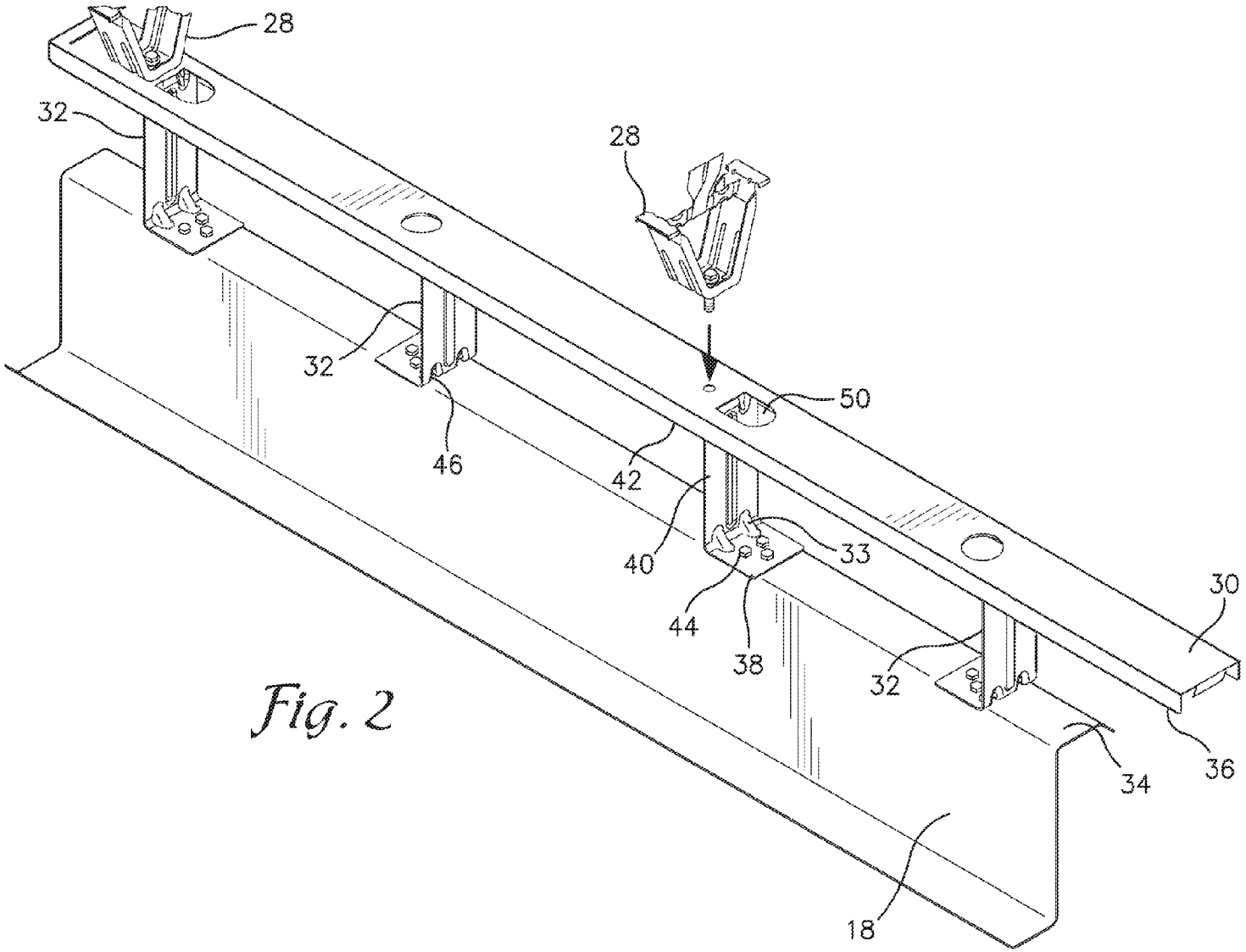
FIG. 2 is a perspective view of an embodiment of the disclosed insulating system disposed atop a purlin.
Figure 10:
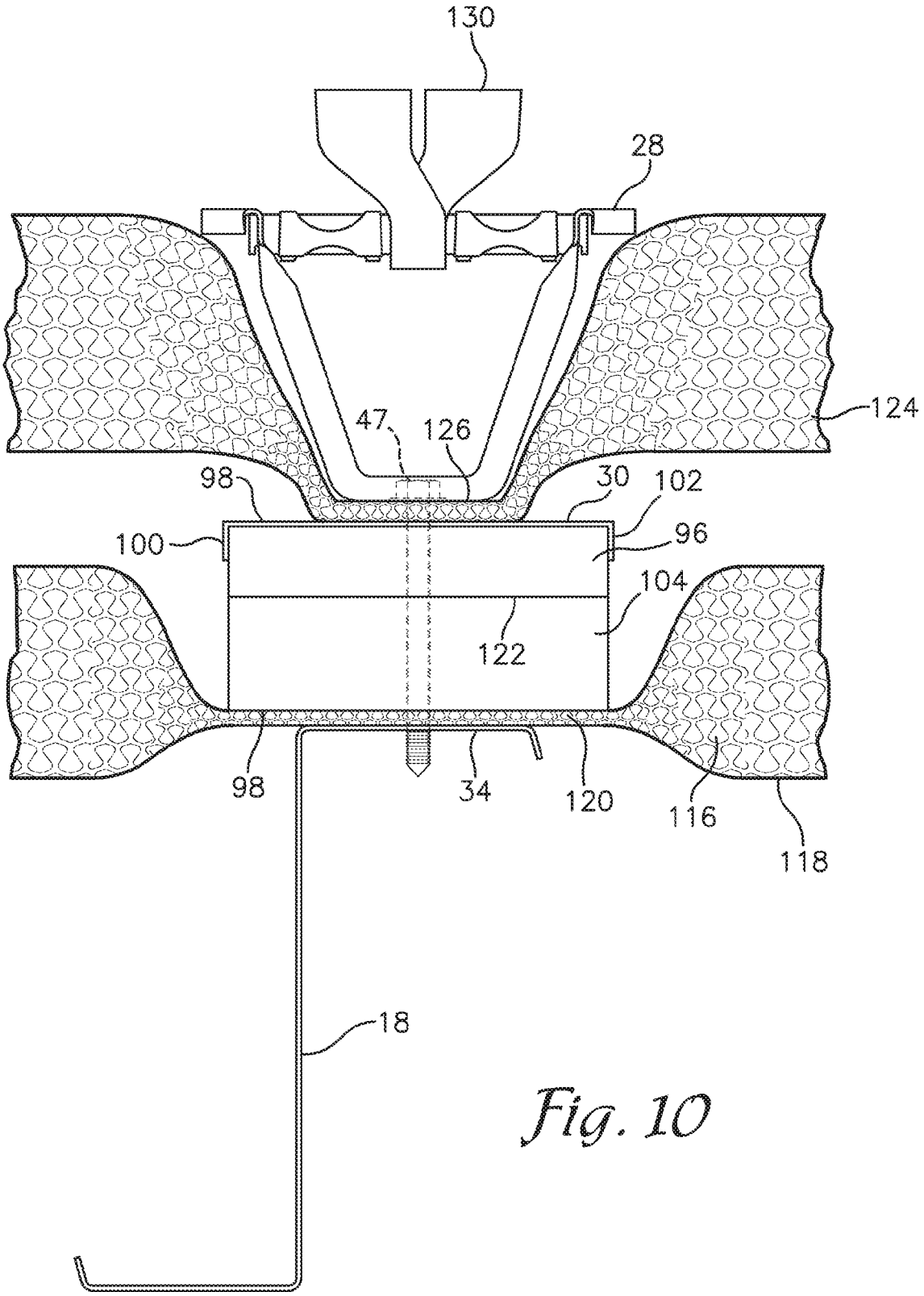
FIG. 10 is a cross sectional view of an embodiment of the disclosed insulating system.
Figure 11:
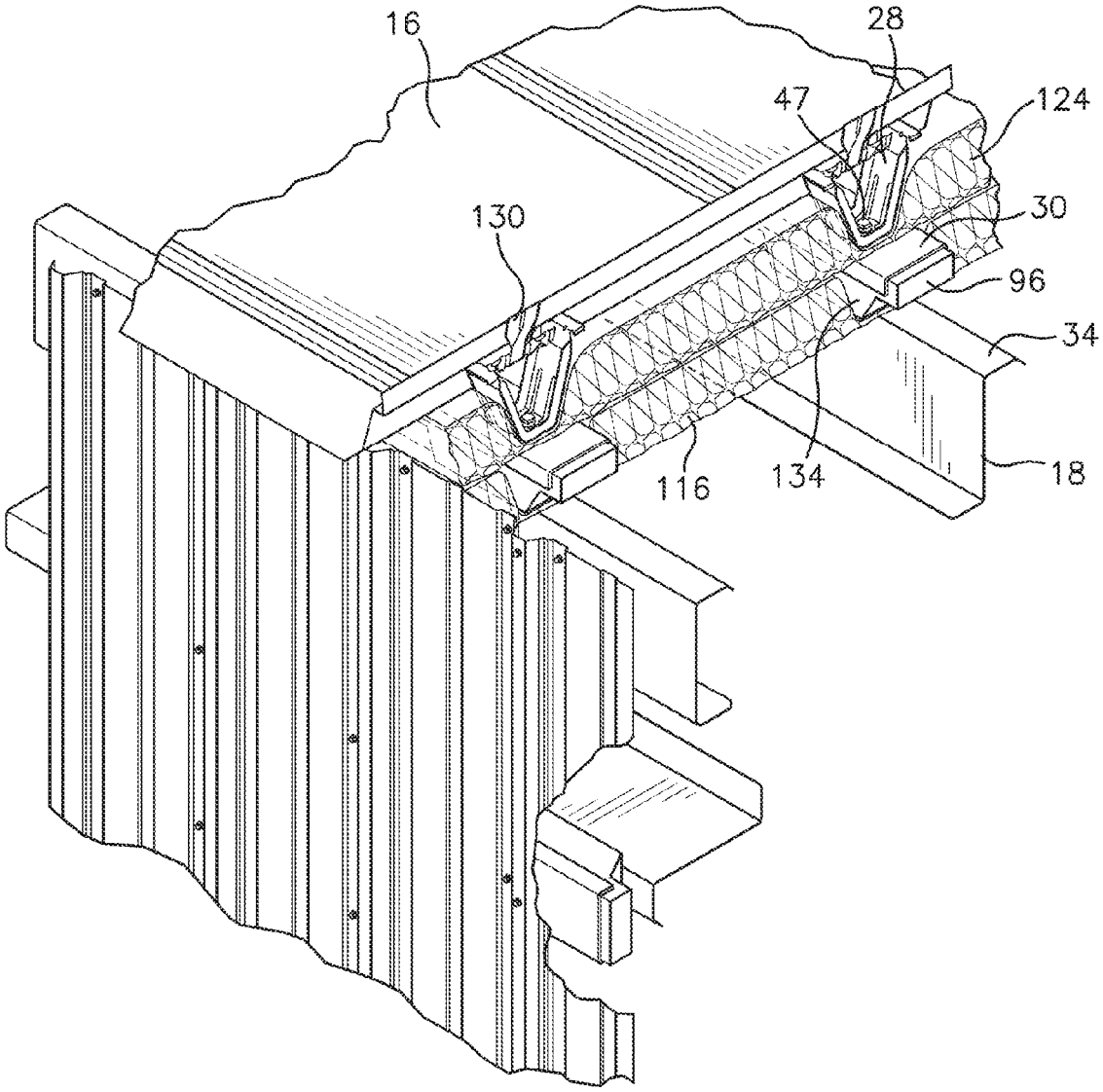
FIG. 11 is a perspective view of an embodiment of the disclosed insulating system.

FIG. 2 illustrates a first embodiment of a purlin 18 mounted insulating system 10 without including the installation of the insulating material. FIG. 2 provides a view, without rolled insulation in place, of the components used to mount the roof clip 28 to the metal bridge 30 and the bridge in turn to the purlin 18. As previously noted, the purlin 18 is a longitudinally extending horizontal structural member in a roof system. Secured to the upper horizontal flange 34 of the purlin 18 is an embodiment of a bracket 32, also generically referred to as a spacer member that separates the metal bridge 30 by a specified distance from the upper horizontal flange 34 of the purlin 18. The separation distance provided by the bracket, or spacer member, provides an open space for uncompressed rolled insulation thereby maximizing the thermal efficiency of the insulating elements. When fully installed in new construction two layers of insulation are incorporated as shown in FIGS. 10 and 11.

The brackets 32 may be fabricated in varying heights to accommodate different thicknesses of insulation that are positioned between the bottom 36 of the metal bridge 30 and the upper horizontal flange 34 of the purlin 18. In colder climates it may be preferred to increase the thickness of the insulation and therefore taller brackets 32 may be employed to accommodate the increased thickness.

Figure 13:
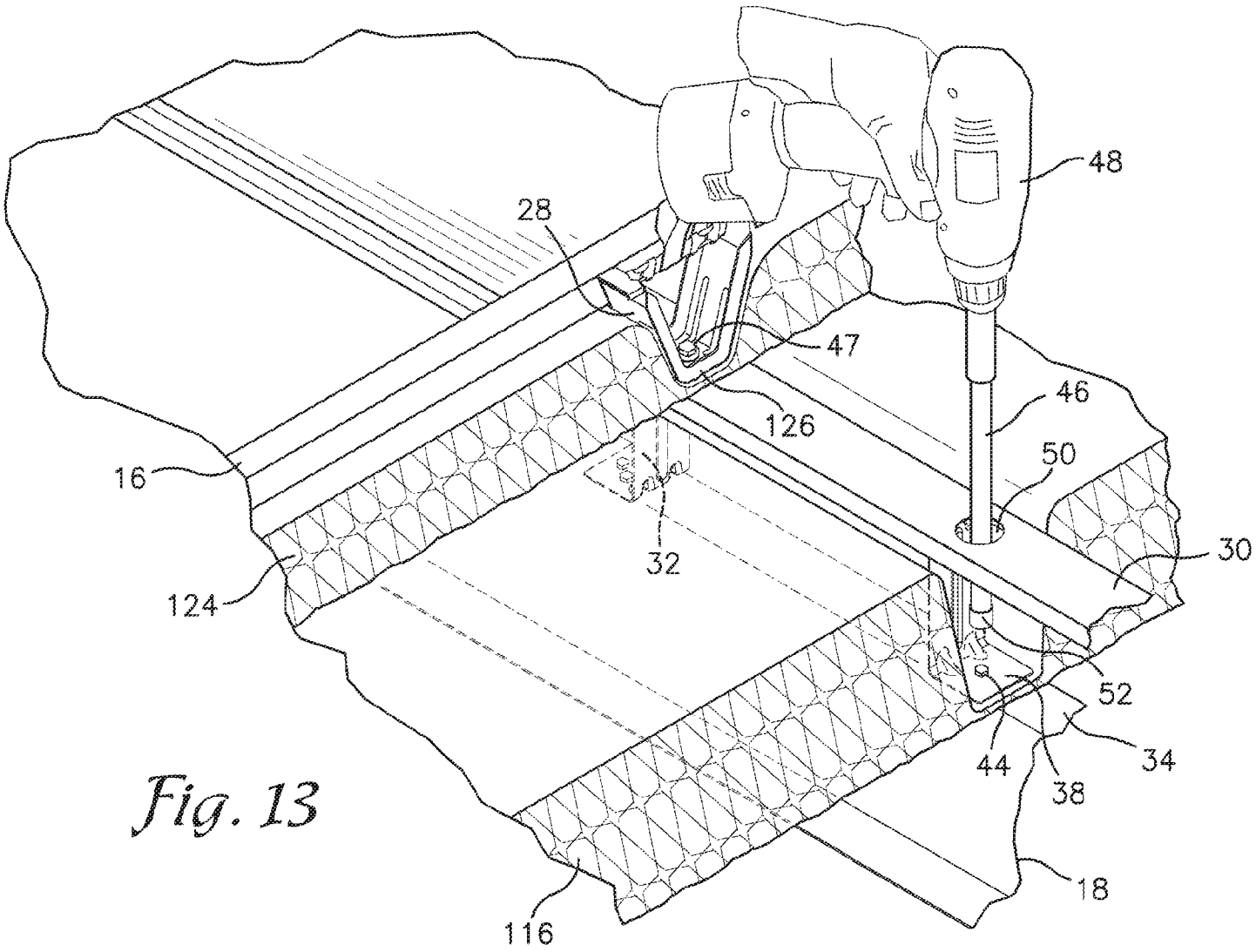
FIG. 13 is a perspective view of a partial embodiment of the disclosed insulating system.

As seen in FIG. 2 the bracket 32 is a Z-shaped component with a lower flange 38, a connecting span 40 and an upper flange 42 (obscured beneath the metal bridge 30). The lower flange 38 includes at least one through hole, and preferably several, allowing for threaded attachments 44 to pass through the lower flange and into the upper horizontal flange 34 of the purlin 18. The procedure for attaching the lower flange 38 of the bracket 32 to the upper flange of the purlin 18 is best seen in FIG. 13. In that Figure, an extension 46 on an electric drill 48 passes through a cutout 50 in the bridge 30 to allow the socket 52 to engage the threaded attachment 44 and to draw the threaded attachments 44 down tight against lower flange 38, the first layer of insulation 116 (causing local deformation of the rolled insulation) and the upper horizontal flange 34 of the purlin 18. Once the nut 44 is fully tightened, the socket and extension 46 are withdrawn back through the cutout. Prior to installing the metal bridge 30 in position atop the purlin 18 the upper flange 42 is secured to the metal bridge 30 with a plurality of threaded fasteners, or alternatively, the upper flange 42 is connected to the bridge 30 at the factory during fabrication by welding or by other means of mechanical fastening. As seen in FIG. 2, all bracket 32 designs preferably utilize one or more stiffener gussets 33 stamped into the bracket material at the junction of the connecting member 40 and the upper and lower flanges 42, 38.

Figure 3:
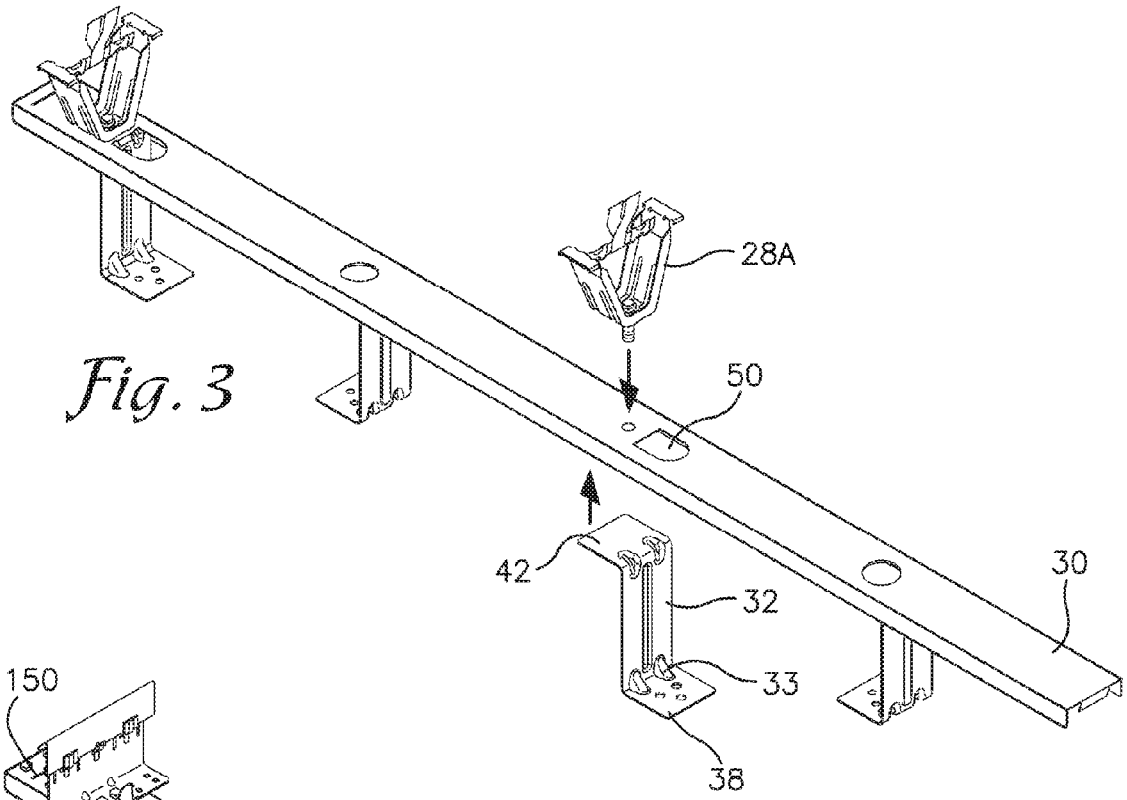
FIG. 3 a perspective view of components of an embodiment of the disclosed insulating system.
Figure 4:
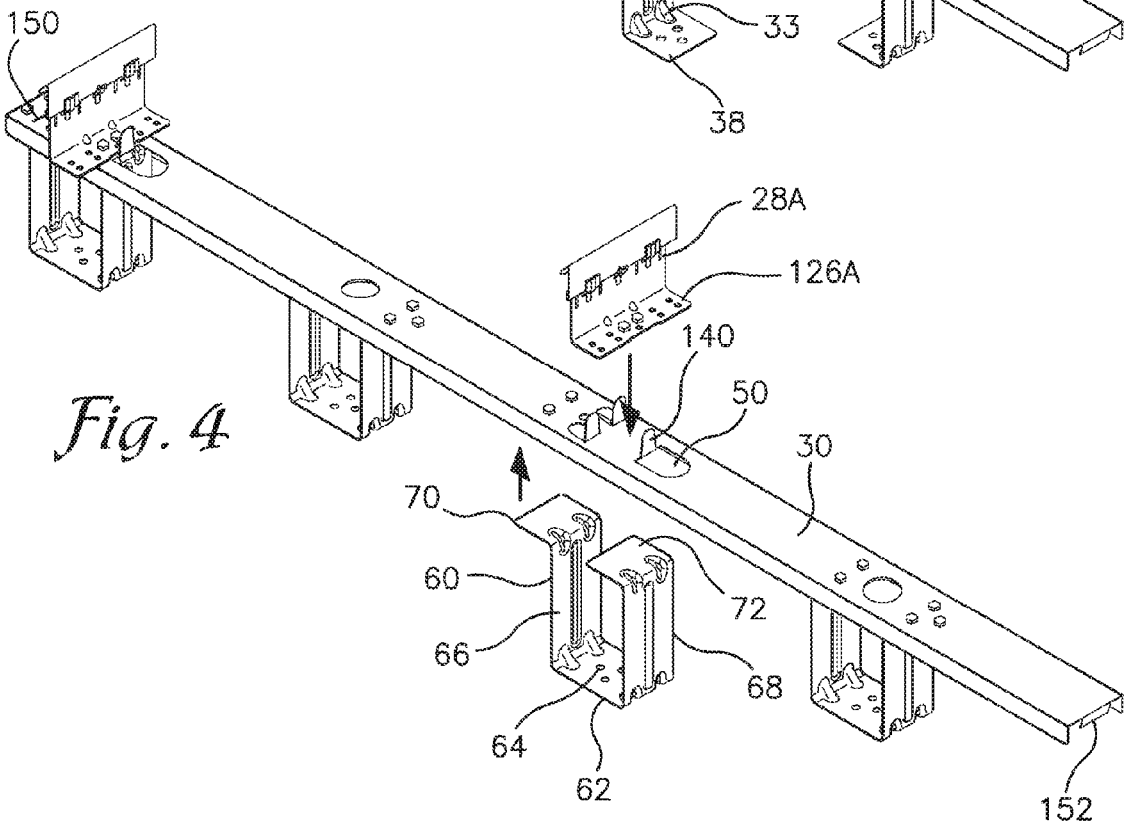
FIG. 4 a perspective view of components of an embodiment of the disclosed insulating system.

FIG. 3 reveals the first embodiment of the bridge bracket 32, also shown in FIG. 2, while FIG. 4 reveals a second embodiment of the bracket 60 that includes two connecting spans 66, 68. The embodiment shown in FIG. 4 includes a lower flange 62 with a plurality of openings 64 as well as two horizontal upper flanges 70, 72. This embodiment can provide increased crush resistance as compared to the embodiment shown in FIG. 3, for the roof when heavy loads, from snow, are anticipated. FIG. 4 also reveals a bridge 30 with upwardly extending tabs 140 that ensure the roof clips 28A are positioned so that a fastener passes through the base 126A of the roof clip 28A, the bridge 30 and then the upper flange 42 of the bracket 32.

Figure 5:
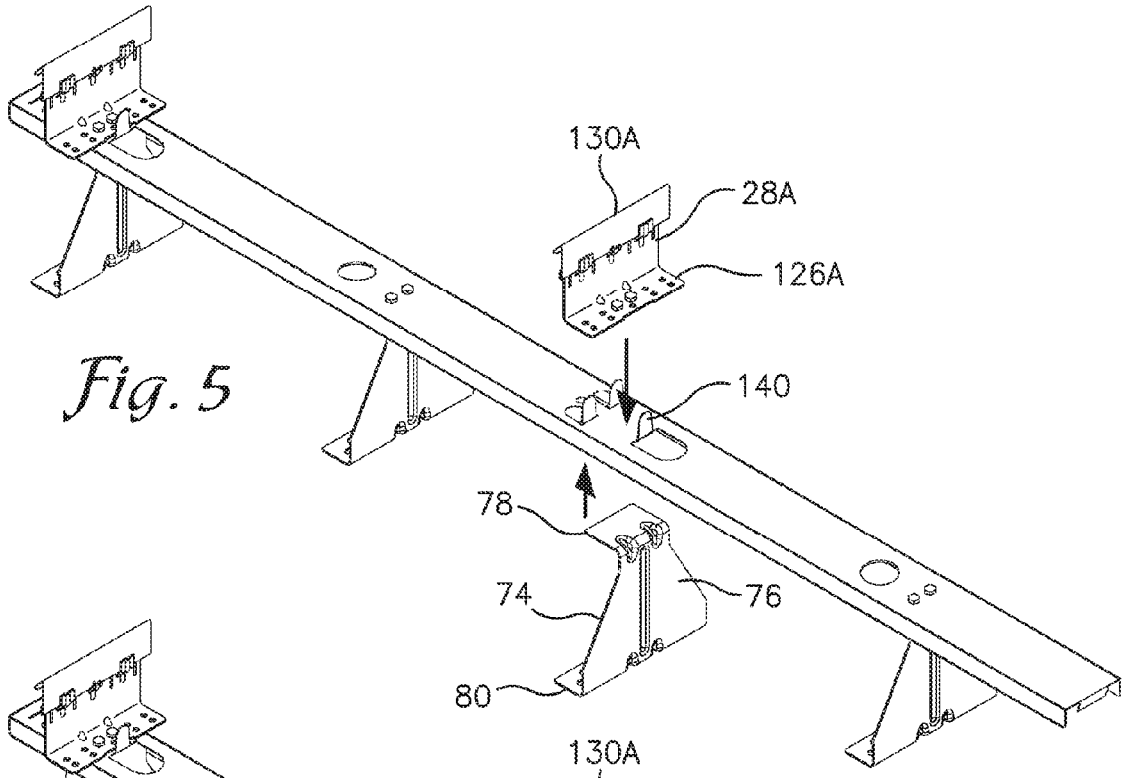
FIG. 5 a perspective view of components of an embodiment of the disclosed insulating system.
Figure 6:
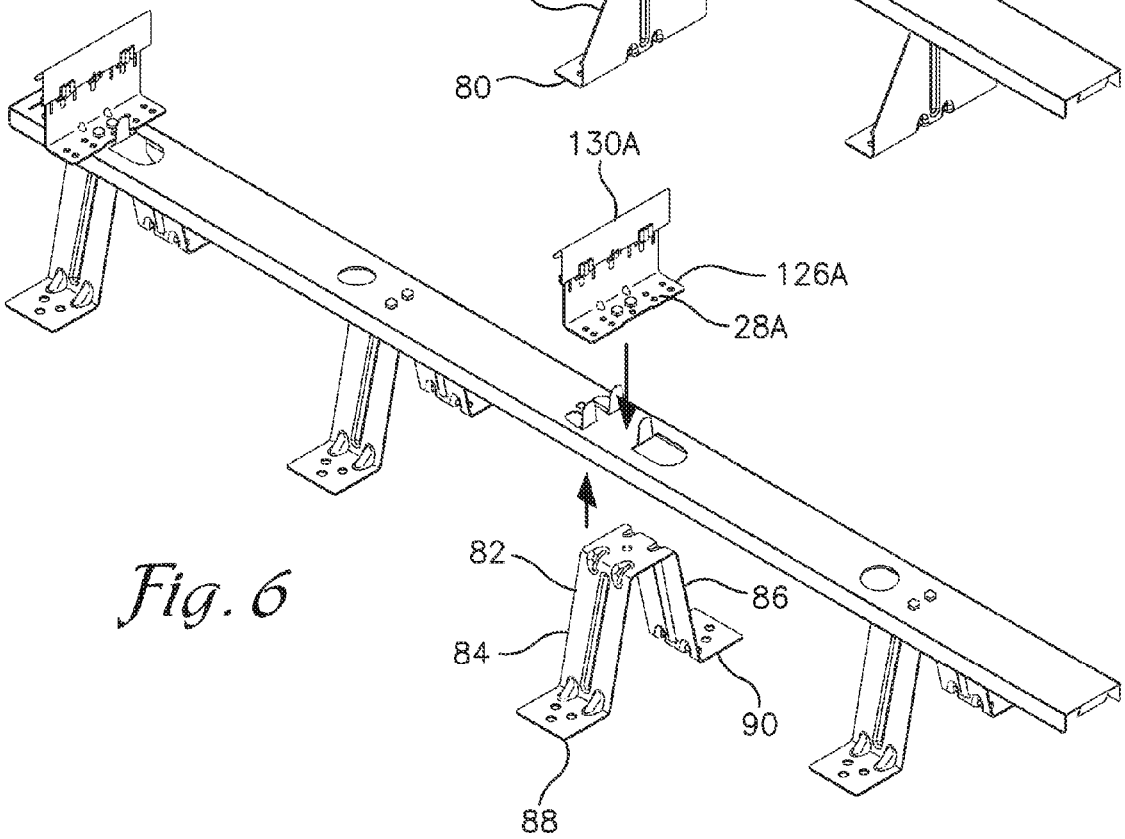
FIG. 6 a perspective view of components of an embodiment of the disclosed insulating system.

FIG. 5 reveals a third embodiment of the bridge bracket 74 that is triangular in shape for mounting to a wide upper flange 34 of a purlin 18. This embodiment provides additional load carrying capacity as compared to the first bracket embodiment 32. This third bracket embodiment 74 includes a triangular connecting span 76 along with upper and lower flanges 78, 80 for mounting to the bridge 30 with threaded fasteners and to the purlin upper flange 34 at the bridge bracket's lower flange 80. A fourth embodiment is shown in FIG. 6 and details a bracket 82 with a bipod configuration. Two legs 84, 86 support the bracket 82 and are fabricated with side flanges 88, 90 that are secured to the upper flange of a purlin 18 (not shown).

In lieu of metal brackets, as discussed immediately above, an alternative to separating the bridge 30 and providing space for placement of the rolled insulation, which retains the roof clip 28, 28A in position, from the purlins 18 is an insulating block, also generically referred to as a spacer member. Insulating blocks are preferably fabricated from high quality insulating materials, such as ASTM C578-Type VI extruded polystyrene. As seen in FIG. 10, the insulating blocks, 96, 104 which can be of any specified height, are positioned atop the first layer of insulation 116, thereby causing localized deformation of the rolled insulation, which is placed over the upper flange 34 of the purlin 18. Atop the insulating block 96 rests the metal bridge 30. Atop the bridge 30 is laid a second layer of insulation 124 that is locally compressed by the base 126 of the roof clip 28.

Figures 7, 8, 9:
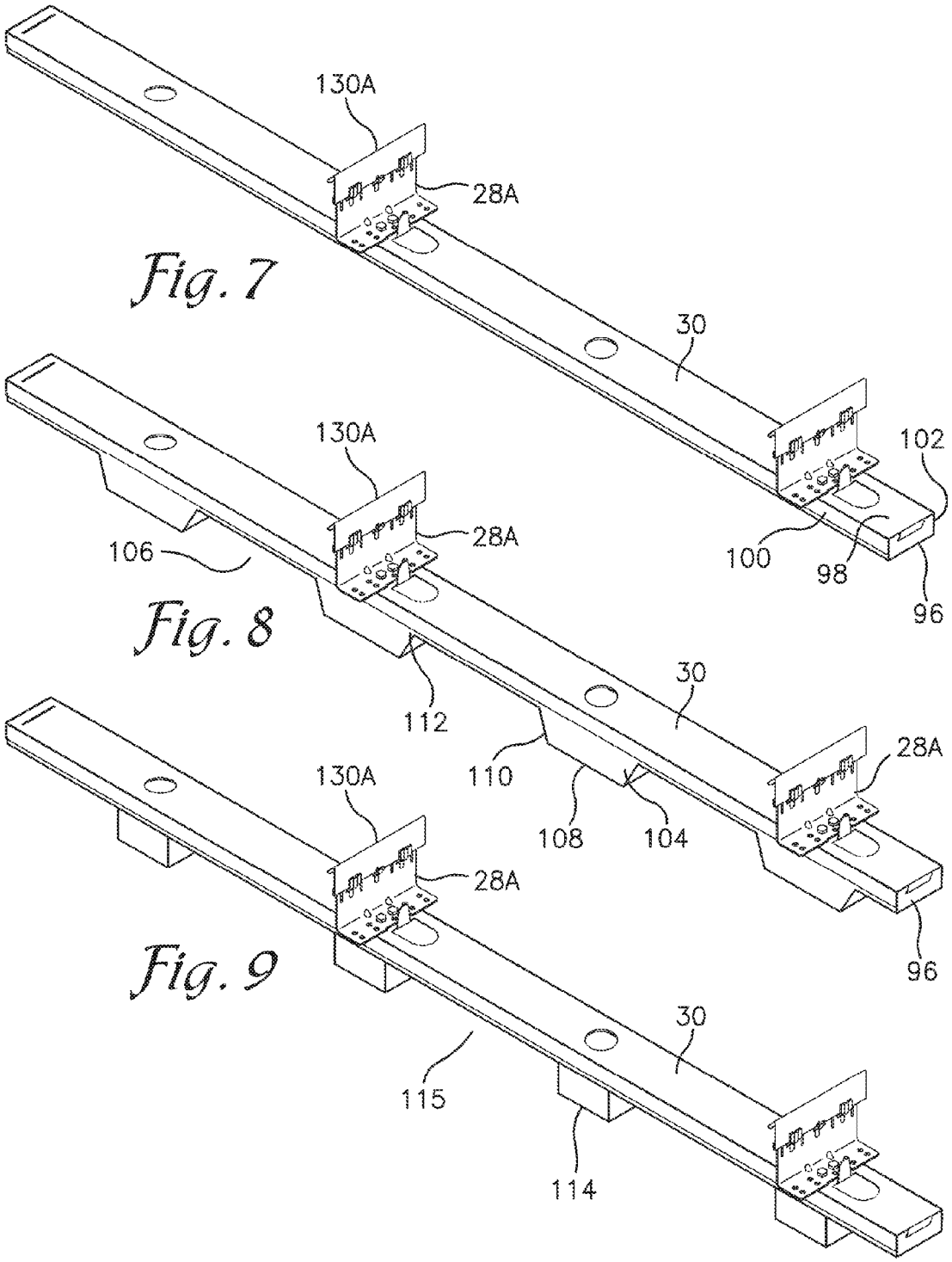
FIG. 7 a perspective view of components of an embodiment of the disclosed insulating system.
FIG. 8 a perspective view of components of an embodiment of the disclosed insulating system.
FIG. 9 a perspective view of components of an embodiment of the disclosed insulating system.

FIG. 7 details an embodiment of a portion of the insulating system 10 employing a plurality of clips 28A secured through a standard metal bridge 30 to other features of the insulating system and into the structural elements of the building. Also shown in FIG. 7 is an insulating element 96 disposed beneath the metal bridge 30 and effectively surrounded on three sides by the top surface 98 of the bridge as well as the two side surfaces 100, 102. The insulating element 96 is preferably comprised of a foam type material with very low heat transfer characteristics but also possessing a sufficiently high resistance to compressive loads. An exemplary insulating element 96 is fabricated from extruded polystyrene satisfying the requirements of ASTM C578-Type VI to include approximately a 40 psi compressive strength and a thermal resistance of R-5/inch. Other materials with comparable characteristics may also satisfy the desired operational requirements for the insulating system 10.

FIG. 8 details yet another configuration of the insulating system shown in FIG. 7. This portion of the insulating system details a plurality of blocks 104 disposed beneath and monolithic with the insulating element 96. The blocks 104 are configured to extend downwardly on an intermittent basis providing gaps 106 for through passage of insulation (not shown). FIG. 8 reveals an insulating block 104 with a flat bottom 108 and canted sides 110. The flat bottom 108 of the insulating block 104 rest against and compress a layer of rolled insulation that is positioned over the upper flange 34 of a purlin 18. The upper surface 112 of the insulating block 104 rest against a lower surface of the insulating element 96.

In the embodiment detailed in FIG. 9, block 114 comprises a rectangular configuration. The rectangular insulating blocks 114 are of a lesser dimension than the block embodiment 104 detailed in FIG. 8 and locally compress less of the rolled insulation; however, the block embodiment shown in FIG. 9 also has a reduced capacity to carry roof loads due to the lesser footprint surface area of the insulating blocks 114. Likewise, the insulating blocks 114 are intermittently disposed providing gaps 115 for through passage of uncompressed insulation (not shown).

FIG. 10 reveals a cross sectional view of the insulating system 10. The cross sectional view shown in FIG. 10 reveals a purlin 18 with an upper flange 34. Positioned atop the upper flange 34 is a rolled layer of insulation 116. This insulation preferably has thermal resistance of at least R-19 and preferably employs a downward looking face layer 118. The layer of insulation 116 is positioned between the flange 34 of the purlin 18 and the bottom surface 120 of the insulating block 104. Positioned atop and also covering the two sides 100, 102 of the insulating element 96 is the metal bridge 30.

Positioned atop the upper surface 98 of the metal bridge is a second layer of insulation 124. This layer of insulation preferably has a thermal resistance equivalent to at least R-25. The layer of insulation 124 experiences localized compression between the base 126 of the clip 28 and the top surface 98 of the metal bridge 30 and to a lesser extent immediately adjacent the base 126. The entire assembly of dual layers of insulation 116, 124, insulating block 108 and insulating element 96 is secured in position by passing a threaded fastener 47 through the base 126 the upper layer of insulation 124, the insulating element 96 the block 104, the lower layer of insulation 116 and into the upper flange 34 of the purlin 18. When these components are fully installed as detailed above the roof panels 16 are secured to the roof clip tab 130 of the roof clip 28 to complete the roof installation.

The insulating block 104 and the insulating element 96 shown in FIG. 10 provide an alternative embodiment to the brackets 32, 60, 74, 82 that are employed to provide separation between the upper flange 34 of the purlin 18 and the base 126 of the clip 28. As previously discussed, the brackets 32, 60, 74, 82 may be of many different configurations and sizes to accommodate the desired thermal characteristics of the building.

FIG. 11 details a perspective view of the insulating system 10 fully configured atop a building with the roof panels 16 secured in position. FIG. 11 details the purlins 18 in position as roof structural features. Resting atop the upper flange 34 of the purlin 18 is the lower layer of insulation 116. Resting atop the lower layer of insulation are intermittently spaced insulating blocks 134. The blocks 134 depicted in FIG. 11 utilize a triangular configuration that minimizes the amount of surface contact with the lower insulation layer 116. This narrow line contact between the block 134 and the insulation serves to minimize the heat conduction path and increase the thermal efficiency of the building. Monolithic with, and disposed atop the insulating block 134, is the insulating element 96 that can vary in thickness from less than inch to several inches depending upon the desired thermal efficiencies of the building.

Resting atop the insulating element 96 is the metal bridge 30 that provides further structural support to the insulating system 10. The upper layer of rolled insulation 124 is positioned atop the metal bridge 30 and is rolled in a direction perpendicular to the purlin orientation, as best seen in FIG. 11. The roof clip 28 fastener 47 passes through the upper insulation 124, the metal bridge 30, insulating element 96, insulating block 134 and lower insulation 116 and is secured to the purlin flange 34.

Figure 12:
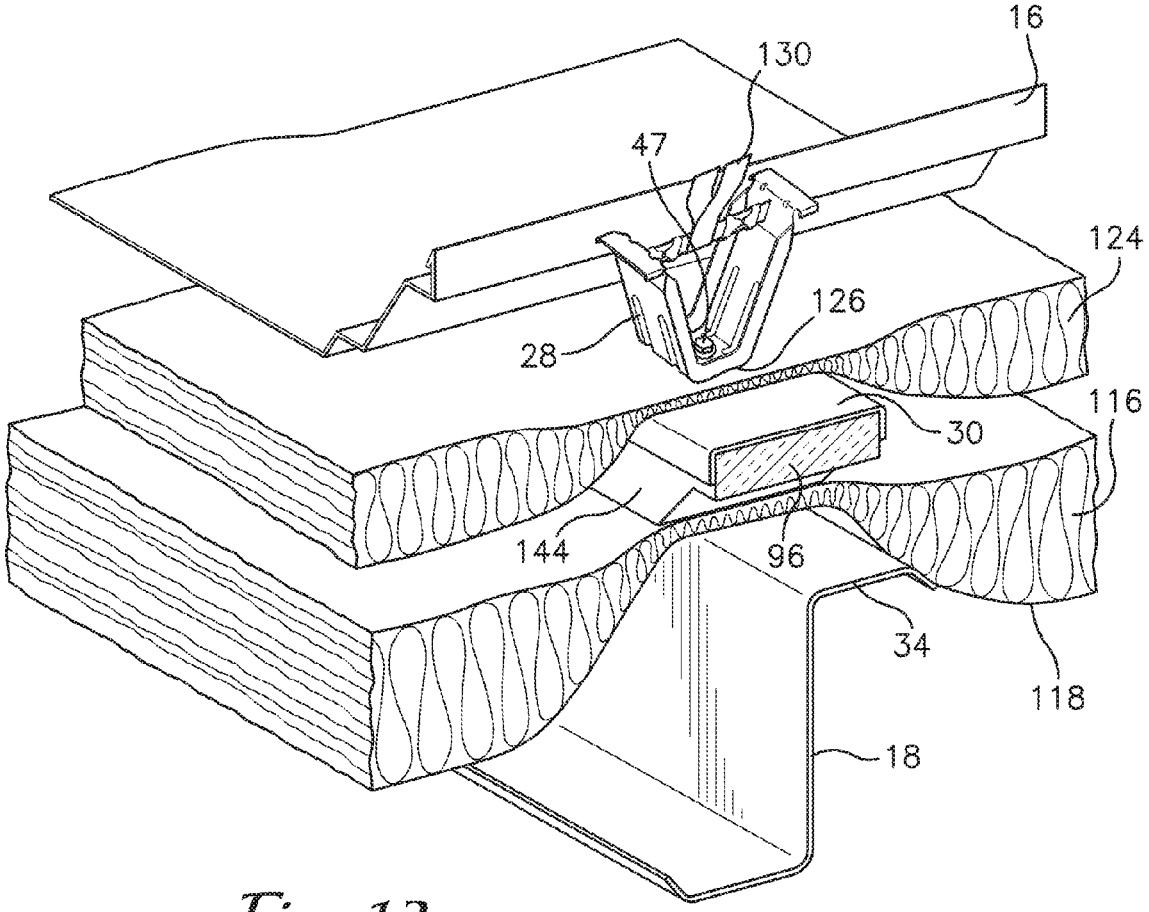
FIG. 12 is a perspective view of an embodiment of the disclosed insulating system.

FIG. 12 provides another perspective view of the insulating system 10 showing the standing seam roof panels 16 engaged with the roof clip 28 and also detailing the two layers of insulation 116, 124, the metal bridge 30, the insulating element 96 and the insulating block 144.

FIG. 13 details a metal bridge 30 utilizing a basic Z-shaped bracket 32. The brackets 32 are preferably attached to the underside of the metal bridge 30 during fabrication by welding or other means of mechanical fastening and come as an assembled unit in various bridge lengths with a four foot length being standard.

The above discussion is directed to the installation of an insulating system to roof of the structure but is equally applicable to the walls of a structure. The description set forth above and as further detailed below should not be construed as limiting the applicability of the insulating system to just roof structures. The disclosed system is also fully capable of insulating a wall of a structure that does not employ a girt but instead utilizes a substrate such as wood. The same insulating block or bracket system is secured to the building substrate and ultimately secured to a wall or roof panel and the disclosed system should not be viewed as constrained to metal pre-fabricated building components. The same insulating block or bracket system may be used to retrofit or reroof an existing building, and may not be secured directly to an existing roof deck or structural system.

The description of the installation of the insulating system 10 begins with a roof structure that is comprised of bare purlins 18. A layer of rolled insulation 116, preferably with facing layer 118, is laid transversely across the purlins 18. Next, depending upon the specifications of the building owner, a bracket 32 embodiment or an insulating block 104, 114 embodiment is selected. An exemplary embodiment of a bracket assembly, as seen in FIG. 3 is comprised of a bridge 30 with brackets 32 pre-welded or fastened with other mechanical means to the underside of the bridge 30 at the upper flange 42 of the bracket. The bracket also includes a lower flange 38 that extends outwardly and includes a plurality of holes for anchoring the bracket to the purlin 18. The bridge with the plurality of intermittently spaced brackets 32 is positioned atop the layer of insulation 116 and locally compresses the insulation adjacent the brackets. Just beyond the lower flange 38 the insulation quickly expands to full thickness and also maximum thermal resistance until, moving laterally along the rolled insulation, the next bracket 32 is encountered where the insulation is again locally compressed. As best seen in FIG. 13, to secure the brackets 32 and bridge 30 to the upper flange 34 of the purlin at least one threaded fastener 54 is passed through the lower flange 38, through the compressed insulating layer 116 and into the upper flange 34 of the purlin. A power drill 48 is preferably employed with a long extension 46 and a socket 52 for efficiently rotating the threaded fastener 44 through the upper flange 34 of the purlin 18. This process is repeated as necessary to secure all of the brackets 32 to the purlin flange 34.

To span the entire roofing structure multiple bridge or bracket assemblies may be required. As seen in FIG. 4 each bridge is fabricated with a tab 152 at one end and a slot 150 at the opposite end. The tab 152 of a first bridge engages the slot 150 of a second adjacent bridge tying the two bridges together and providing for a highly linear path for the roofing panels 16 when ultimately installed.

As again best seen in FIG. 13, once the bridge and bracket assemblies are installed a second layer of insulation 124 is laid transversely over the bridge 30. This layer of insulation is preferably unfaced. Once this layer of insulation is in position the installer then clears an opening for placement of the clip 28. A threaded fastener 47 is then passed through the base 126 of the roof clip 28. The threaded fastener 47 extends through the bridge 30 thereby securing the roof clip 28 to the top flange 42 of the bracket 32 which in turn is secured to the upper flange 34 of the purlin 18.

Once the clips 28 are in position the roof panels are then laid in position over the second or upper layer of insulation 124 and secured to the roof clip 28 in a manner that is well known in the industry. Alternatively an insulating spacer block may be applied over the secondary layer of insulation at the bridge locations adding a thermal resistance and support for the panel. The roof panels are then seamed along with the roof panel tabs 130 in position. This roof structure is configured to resist the transfer of heat and is also water resistant.

As an alternative to the use of the bracket 32 configuration, as disclosed in FIG. 10, insulating blocks may be employed immediately above the first layer of insulation 116. The insulating blocks 104 and insulating element 96 are preferably monolithic in configuration but may optionally be separate and combined as specified. As the insulating blocks 104 are placed atop the insulation 116, the insulation locally compresses adjacent the insulating blocks and expands a short distance away from the blocks returning to full thickness and thermal resistance. The insulating blocks, where the insulation is fully compressed atop the purlin upper flange 34, serve to minimize the transfer of heat and increase the thermal efficiency of the roof or wall structure.

As seen in FIG. 10, the insulating block 104 and insulating element 96 and bridge 30 are then covered by a second layer of insulation 124 and the roof clip 28 with associated panel clip tab 130 are positioned atop the bridge thereby locally compressing the second insulation layer 124. The installer, as detailed above, must then pass a threaded fastener 47 through the bridge 30, the base 126 of the roof clip 28, through the insulating element 96 and insulating block 104 and into the upper flange 34 of the purlin 18. The threaded fasteners effectively secure the insulating system 10 to the purlins 18 of the structure. Once the roof clips 28 are in position the roof panel tab 130 may be integrated into the standing seam roof of the structure as is commonly performed in the industry.

Figure 14:
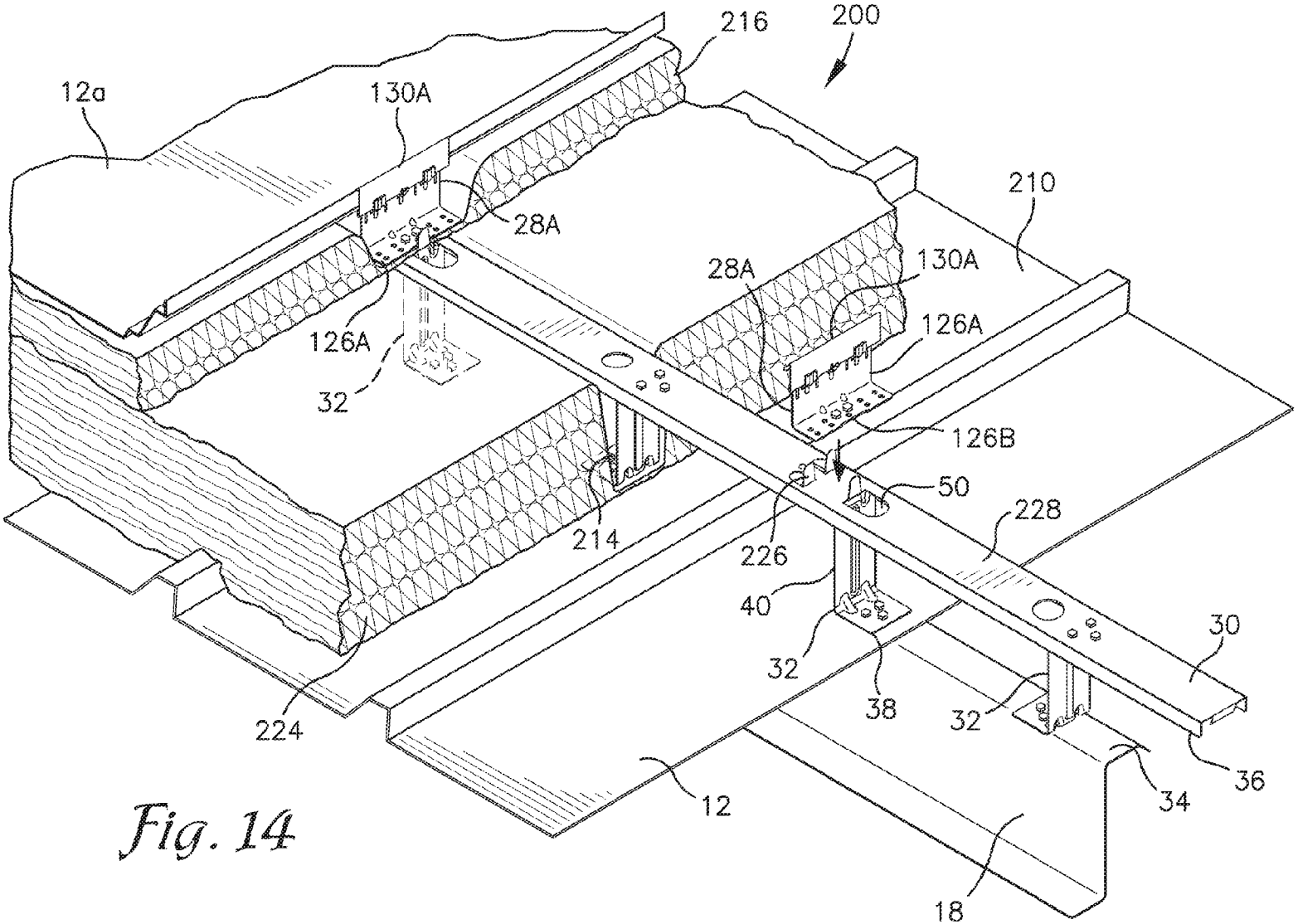
FIG. 14 is a perspective view of an embodiment of a retrofit insulating system for a roof structure.
Figure 15:
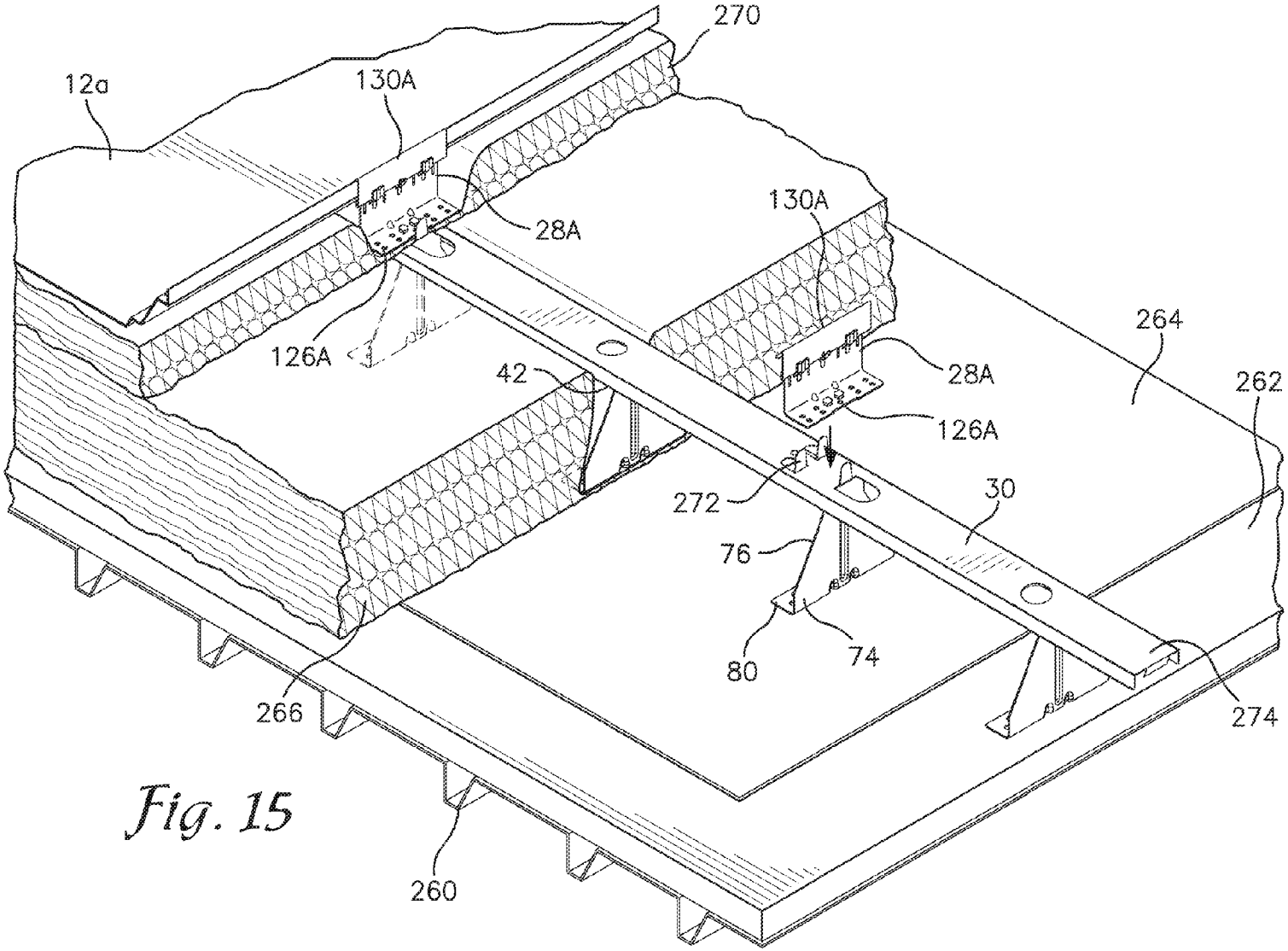
FIG. 15 is a perspective view of an alternative embodiment of a retrofit insulating system for a roof structure.

When retrofitting the roof or walls of a building to address either thermal inefficiencies or a compromised roof, such as when moisture seeps through roof penetrations into the structure, there exists the option of overlaying another roof layer, or wall layer, on top of or adjacent to the existing structure as seen in FIGS. 14 and 15. FIG. 14 illustrates an under construction retrofit system 200 that facilitates the placement of roof panels 12*a* and a bridge member 30 atop an existing roof structure 210. The existing roof panels 210, which may be of many different profile configurations, are generally supported by purlins 18 and the retrofit system 200 includes the installation of bridge members 30 with spacer members 32 creating a space between the originally installed roof panels 210 and the bottom surface of the bridge member 30. In a preferred embodiment of the retrofit system 200, rolled fiberglass insulation 224 is positioned over the entire existing roof panel 210 and transverse to the roof purlins 18.

The spacer members 32, as previously discussed, are secured to the underside of the bridge members 30, preferably by spot welding or by threaded fastener through the upper flange 42 (best seen on FIG. 3). The lower flange 38 is secured to either the existing roof panel 210 or the underlying purlin 18 with threaded fasteners 214. The fasteners 214 preferably pass through the highly compressed layer of rolled insulation 224 proximate the lower flange 38 before passing through the existing roof 210 and into the purlin 18. A short distance away from the lower flange 38 the insulation thickness quickly increases to its maximum. When insulation is at its maximum thickness the capacity to resist heat transfer is also at its greatest.

As seen in FIG. 14, the height of the connecting span 40 of the spacer member 32 may also be customized for a roof or wall application. Colder climates may require a greater span height 40 to accommodate thicker insulation and warmer climates may not require the installation of any insulation and therefore a very short connecting span 40 may be employed. A second layer of rolled insulation 216 is also preferably laid over and perpendicular to the longitudinally extending bridge member 30. As discussed above, a plurality of panel clips 28A each with a base 126A and a panel clip tab 130A disposed opposite the base are positioned atop the bridge 30. The base 126A of the panel clips 28A locally compress the second layer of insulation 224 much as the lower flange 38 locally compresses the first layer of insulation 216.

The panel clips 28A are preferably positioned within a nest of three tabs 226 extending upwardly from the upper surface 228 of the bridge 30. The upwardly extending tabs 226 facilitate locating the panel clip 28A by the installer at the proper location on the bridge. The installer presses down on the insulation 224 in the area where she believes the tabs 226 are located and the upward extension of the tabs 226 provides a positive identification of the location. The base 126A preferably include a notch 126B for facilitating placement of the clip 28A so as to have a tab 226 slide into the notch 126B. The installer then secures the clip 28A to at least the bridge and alternatively to the existing roof panel 210 or possibly even the underlying purlin 18. Once the roof clips 28A are in position the roof panel tab 130 may be integrated into the standing seam roof of the structure as is commonly performed in the industry.

FIG. 15 reveals an alternative configuration for retrofitting an existing roof structure. FIG. 15 illustrates an existing roof deck 260 that is overlain with a rigid insulating material 262. Placed atop the rigid insulating material 262 is a roof membrane 264. The longitudinally extending bridge member 30, as with the embodiment detailed above is elevated off of the underlying surface by a plurality of spacer members 74 with connecting spans 76 that may be specified at a particular length depending upon the local climate and the need for additional or lesser insulation thickness. The lower flange 80 is secured to the roof deck 260 with fasteners and the upper flange 78 (best seen in FIG. 5) is preferably spot welded to the underside of the bridge member 30. The retrofit embodiment detailed in FIG. 15 may also optionally include a layer of insulation 266 disposed above the roof membrane 264. The spacer member configurations 32, 74 detailed in FIGS. 14 and 15 are illustrative of the various embodiments of spacer members that may be employed in a roof or wall insulating system retrofit. Multiple configurations of spacer members along with a wide range of heights of the connecting spans may be employed to satisfy the specific needs of the owner or operator of the structure being retrofitted.

If a layer of insulation 266 is laid atop the roof membrane 264 prior to the installation of the spacer members 74, the spacer member lower flange 80 is placed atop the insulation 266 and compresses the insulation in the vicinity of the lower flange 80. The spacer member is secured to the roof deck 260 or possibly even an underlying purlin with threaded fastener (not shown) that passes through the lower flange 80, the layer of insulation 266 and then into the roof deck 260. Once the bridge 30 is securely fastened to the roof deck 260 through the spacer members 74 a second layer of insulation 270 may optionally be laid atop, and transverse to, the bridge 30. The utilization of a second layer of insulation 270 is generally dependent upon the climactic conditions at the location where the structure is located. In a colder climate the building owner or operator may prefer the installation of additional insulation.

Once the second layer of insulation 270 is positioned atop the bridge 30 a plurality of panel clips 28A each with a base 126A and a panel clip tab 130 disposed opposite the base are positioned atop the bridge 30. The base 126A of the panel clips 28A locally compress the second layer of insulation 270 much as the lower flange 80 locally compresses the first layer of insulation 266. The panel clips 28A are preferably positioned within a nest of three tabs 272 extending upwardly from the upper surface 274 of the bridge 30. The upwardly extending tabs 272 facilitate locating the panel clip 28A by the installer at the proper location on the bridge. The installer presses down on the insulation 270 in the area where she believes the tabs 272 are located and the upward extension of the tabs 272 provides a positive identification of the location. The installer then positions the base 126A of the panel clip 28A into the nest of upwardly extending tabs 272 and passes a fastener through the base 126A of the clip 28A securing it to at least the bridge and alternatively to the roof deck 260 or possibly even the underlying purlin. Once the roof clips 28A are in position the roof panel tab 130A may be integrated into the standing seam roof of the structure as is commonly performed in the industry.

Figure 16:
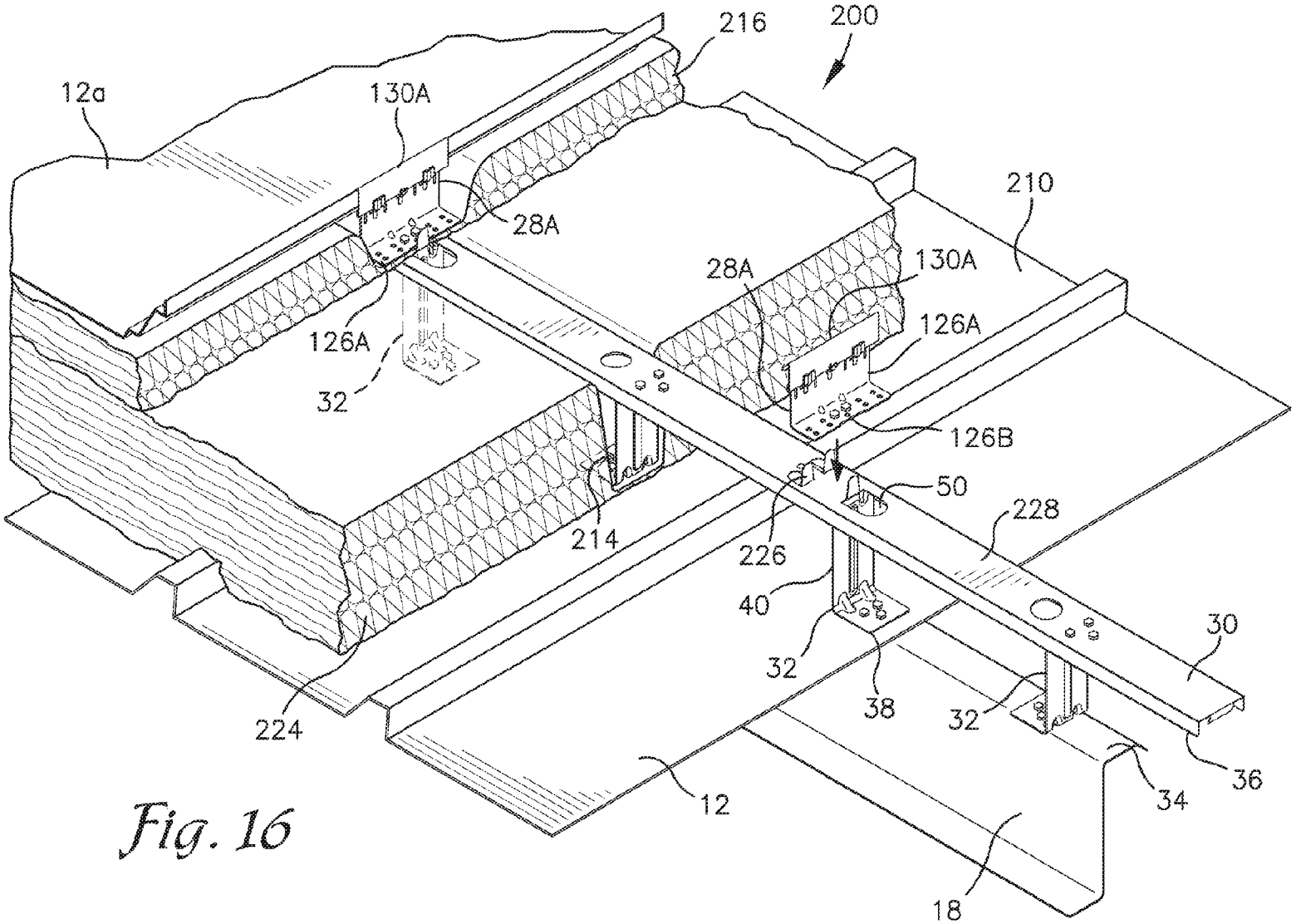
FIG. 16 is a perspective view of an embodiment of a retrofit insulating system for a roof structure.
Figure 17:
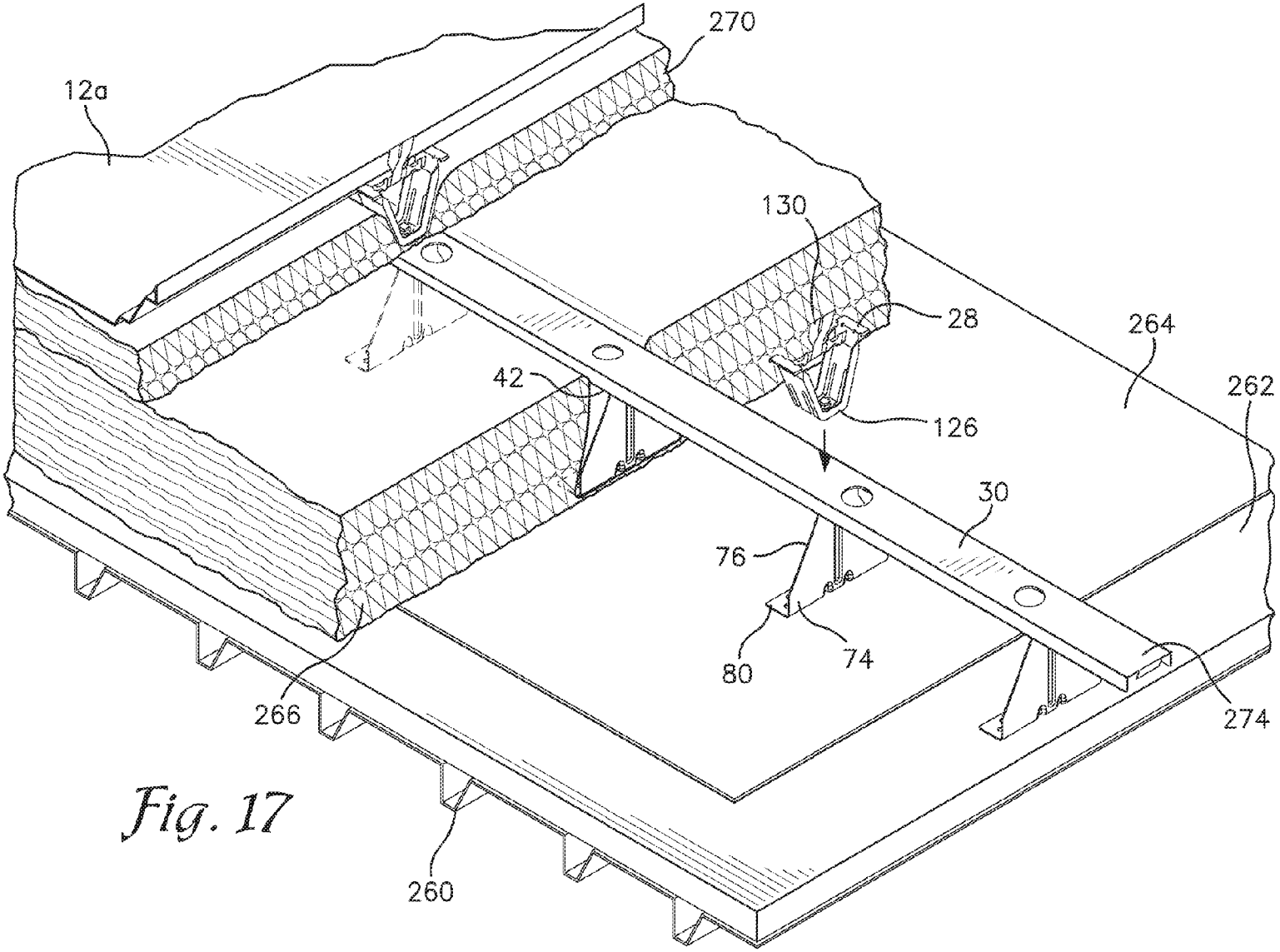
FIG. 17 is a perspective view of an embodiment of a retrofit insulating system for a roof structure.

FIGS. 16 and 17 illustrate the insulating system employing an alternative embodiment of the clip 28 that is secured to the bridge 30. This clip configuration is detailed in FIGS. 2, 3 10, 11, 12 and 13.

Illustrative of a methodology for engaging the roof clips 28 into the room seam is that used in the Butler Buildings MR-24® roof system such as that disclosed in U.S. Pat. No. 4,543,760. The MR-24® roof system relies upon a 360 degree double lock seam to assure complete weather-tightness and structural integrity. The wrap of the MR-24® roof system is machine formed on site as the roof system is installed, assuring a tight permanent seam. The lateral edges 250 of adjacent roof panels 12*a* are engaged with one another to form a rolled seam that incorporates the roof clip tab 130 into the formed seam thereby securing the roof panels 12*a* to the roof clips 28 that is in turn are secured to the bridge members 30. Alternative seaming methodologies may be employed to accomplish the formation of a watertight seal and to also integrate the roof clip tab into the watertight seam.

Many different arrangements of the various components depicted, as well as components not shown, are possible without departing from the spirit and scope of the present invention. Embodiments of the present invention have been described with the intent to be illustrative rather than restrictive. Alternative embodiments become apparent to those skilled in the art that do not depart from its scope. A skilled artisan may develop alternative means of implementing the aforementioned improvements without departing from the scope of the present invention.

It will be understood that certain features and sub-combinations are of utility and may be employed without reference to other features and sub-combinations and are contemplated within the scope of the claims. Not all steps listed in the various figures need be carried out in the specific order described.

We claim:

1. An insulating system for retrofitting a roof or walls of a building, the insulating system comprising:

an existing roof or wall structure;

a first layer of insulating material extending transversely across the existing roof or wall structure;

a plurality of bridge members each with an upper and a lower surface;

a plurality of spacer members longitudinally spaced apart along each of the plurality of bridge members, each spacer member further comprising an upper flange, a lower flange and a connecting member disposed between and connecting the upper and lower flanges, wherein the upper and lower flanges extend substantially perpendicular to the connecting member, the upper flange of the spacer members secured to the lower surface of the bridge member wherein the connecting member extends downwardly to the lower flange and the lower flange is disposed atop and locally compresses the first layer of insulation proximate the lower flange and the lower flange is secured with fasteners to at least the existing roof or wall structure;

a second layer of insulating material extending transversely across the upper surface of the bridge members; and a plurality of panel clips each with a base and a panel clip tab disposed opposite the base, the panel clips disposed atop and locally compressing the second layer of insulation, wherein a fastener is passed through the base of each of the panel clips, through the second layer of insulation, through the bridge member and into the upper flange of the spacer member, the panel clip tabs engaging with the roof or wall panels in the formation of a water resistant seal.

2. The insulating system of claim 1, wherein the longitudinal spacing between the plurality of spacer members is at least 6 inches.

3. The insulating system of claim 2, wherein the plurality of locating tabs is at least three tabs to provide accurate alignment by the installer of the panel clips atop the second layer of insulation and the bridge member.

4. An insulating system for retrofitting a roof and/or walls of a building, the insulating system comprising:

a plurality of longitudinally extending purlins, girts or upper chords of a building to which an existing roof or wall structure is secured;

a first layer of insulating material extending transverse to the purlins, girts and chords and atop the existing roof or wall structure;

a plurality of longitudinally extending bridge members each with an upper and a lower surface and spaced apart through holes;

a plurality of spaced apart spacer members disposed beneath each of the bridge members, the spacer members further comprising at least one upper and one lower flange and at least one connecting member disposed there between, the connecting member substantially perpendicular to the upper and lower flanges, the spacer members connected to and extending downwardly from the lower surface of the bridge member wherein the at least one lower flange locally compresses the first layer of insulating material proximate to the at least one lower flange allowing an otherwise uncompressed first insulation layer to extend between the spacer members, wherein the lower flange is secured to the existing roof or wall structure;

a second layer of insulating material extending transversely across the upper surface of the bridge member; and a plurality of panel clips each with a base and a panel clip tab disposed opposite the base, the base of the panel clips disposed atop and locally compressing the second layer of insulation, wherein a fastener extends through the panel clip base, through the second layer of insulation and the bridge member and the panel clip tab engages with the lateral edges of the roof or wall panels in the formation of a water resistant seam.

5. The insulating system of claim 4, wherein the spaced apart through holes in the bridge members provide access for an installer's drill shank and socket to pass beneath the bridge members in order to drive a fastener through the lower flange of the spacer member and into the existing roof or wall structure.

6. The insulating system of claim 4, wherein the orthogonally extending spacer members include at least one stiffening gusset at the junction between the upper flange and the connecting member and at least one stiffening gusset at the junction between the lower flange and the connecting member.

7. The insulating system of claim 4, wherein the spacer member further comprises two connecting members, two upper flanges and a single lower flange.

8. The insulating system of claim 4, wherein the spacer member further comprises at least two connecting members separated and joined by a lower flange and wherein each connecting member is also joined to an upper flange.

9. The insulating system of claim 4, wherein the spacer member further comprises a triangular shaped connecting member with an upper and lower flange extending outwardly from the connecting member.

10. The insulating system of claim 4, wherein the spacer member further comprises dual connecting members each with a separate upper flange and a lower flange joining the dual connecting members.

11. The insulating system of claim 4, wherein the spacer members are fabricated from a structural grade steel.

12. The insulating system of claim 4, wherein the spacer members are fabricated from an engineered plastic.

13. The insulating system of claim 4, wherein the spacer members are fabricated from an engineered composite.

14. An insulating system for retrofitting a roof and walls of a building, the insulating system comprising:

a plurality of longitudinally extending purlins, girts or upper chords of a building truss to which an existing roof or wall structure is secured;

a first layer of insulating material disposed atop the existing roof or wall structure;

a plurality of bridge members each with an upper and a lower surface and a plurality of spaced apart spacer members disposed beneath each of the bridge members, the spacer members further comprising an upper flange, a lower flange and a connecting member, the connecting member substantially perpendicular to both the upper flange and lower flange, the spacer member connected to and extending downwardly from the lower surface of the bridge member wherein the spacer member compresses the first layer of insulating material proximate to the spacer member allowing an otherwise uncompressed first insulation layer to extend between the spacer members;

a second layer of insulating material extending transversely across the upper surface of the bridge member; and a plurality of panel clips each with a base and a panel clip tab disposed opposite the base, the base of the panel clips disposed atop and locally compressing the second layer of insulation, wherein a fastener extends sequentially through the panel clip base, the second layer of insulation, the bridge member, the spacer member and into the existing roof or wall structure and the panel clip tab engages with the lateral edges of the roof or wall panels in the formation of a water resistant seam.

15. The insulating system of claim 14, wherein the spacer members are comprised of extruded polystyrene.

16. The insulating system of claim 14, wherein the extruded polystyrene has a compressive strength of 40 psi.

17. The insulating system of claim 14, wherein a roof membrane is disposed atop the existing roof or wall structure and beneath the first insulating layer.

18. The insulating system of claim 17, wherein the roof membrane is a thermoset membrane.

19. The insulating system of claim 17, wherein an insulating member is disposed atop the roof membrane and beneath the first insulating layer.

20. The insulating system of claim 19, wherein the insulating member is a closed cell foam sheet.

* * * * *